United States Patent [19]

Smith

[11] 3,985,647

[45] Oct. 12, 1976

[54] CLEATED CONVEYOR BELT

[75] Inventor: Milbourn L. Smith, Glenwood, Ill.

[73] Assignee: Continental Can Company, Inc., New York, N.Y.

[22] Filed: Aug. 7, 1975

[21] Appl. No.: 602,846

[52] U.S. Cl. ..... 209/218; 209/223 A

[51] Int. Cl.[2] ..... B03C 1/20

[58] Field of Search ..... 209/223 R, 223 A, 218, 209/232; 210/222, 223; 198/41

[56] References Cited

UNITED STATES PATENTS

| | | | |
|---|---|---|---|
| 553,446 | 1/1896 | Barnard | 209/223 A |
| 557,121 | 3/1896 | Graves | 209/218 |
| 3,672,496 | 6/1972 | Williams | 209/223 A |
| 3,809,239 | 5/1974 | Barrett | 209/223 A |
| 3,901,795 | 8/1975 | Smith et al. | 209/214 |

FOREIGN PATENTS OR APPLICATIONS

| | | | |
|---|---|---|---|
| 311,387 | 11/1916 | Germany | 209/223 A |
| 1,128,821 | 5/1962 | Germany | 210/222 |
| 465,406 | 9/1951 | Italy | 209/218 |

*Primary Examiner*—Robert Halper
*Attorney, Agent, or Firm*—John J. Kowalik; Joseph E. Kerwin; Paul J. Lerner

[57] ABSTRACT

An improved conveyor belt for use in a magnetic waste separator characterized by the provision of protective cleats mounted transverse the conveyor belt. The cleats are strategically positioned to protect the belt from abrasion caused by the sharp-edged metal fragments being processed. Further, the particular configuration and spacing of the cleats enhances tumbling or bouncing of the separated metal fragments which serves to reduce the amount of entrained non-magnetic materials, thereby increasing separator efficiency.

10 Claims, 3 Drawing Figures

CLEATED CONVEYOR BELT

SUMMARY OF THE INVENTION

The present invention relates to conveyor systems and more particularly, to conveyor belts for use in magnetic waste separators.

Magnetic waste separators, of the type having a continuous belt moving past a magnetic assembly which generates a magnetic field through which the belt moves, are well known, as, for example, Barrett et al 3,809,239. In these separators, magnetic material is attracted to the belt by the magnetic assembly and drawn along by the belt to a collection area whereat further separating or processing may be performed. Prior to separation, the waste is shredded to insure that particle size does not exceed managable levels. Unfortunately, this process produces sharp or razor-edged metal particles which puncture or gouge the belt when attracted thereto. Further, the tendency of the attracted particles to remain in a fixed position relative to the magnetic assembly results in a sliding contact between the particles and the moving belt which causes cutting, scoring and abrading of the belt. Finally, a certain amount of relatively light non-magnetic waste, such as rags and paper, tangled with, or draped over the magnetic particles, is carried along therewith, thus rendering the separation process incomplete. Attempts to solve this problem of entrained non-magnetic materials by agitating the attracted magnetic particles with alternating magnetic polarities have proved only partly successful.

It is therefore a primary object of the present invention to provide an improved conveyor belt, for use in a magnetic waste separator, which provides increased wear resistance and extended belt life.

This is accomplished by providing a plurality of protective, non-magnetic, cleats on the belt strategically positioned shielding the same from the impacts of the attracted magnetic materials and limiting the sliding contact therebetween and effecting erratic bouncing of the aggregate.

It is a further object to reduce the amount of non-magnetic material carried along with the magnetic materials by the bouncing action produced, thereby increasing the efficiency of the magnetic separation process.

This is accomplished by arranging and designing the cleats or slats to promote tumbling of the attracted magnetic particles whereby the entrained non-magnetic materials are freed and enabled to drop away from the conveyor belt.

With the above and other objects in view that will hereinafter appear, the nature of the invention will be more readily understood by reference to the following description, the appended claims and the several views illustrated in the accompanying drawings.

IN THE DRAWINGS

DESCRIPTION OF THE PREFERRED EMBODIMENT

Figure 1:
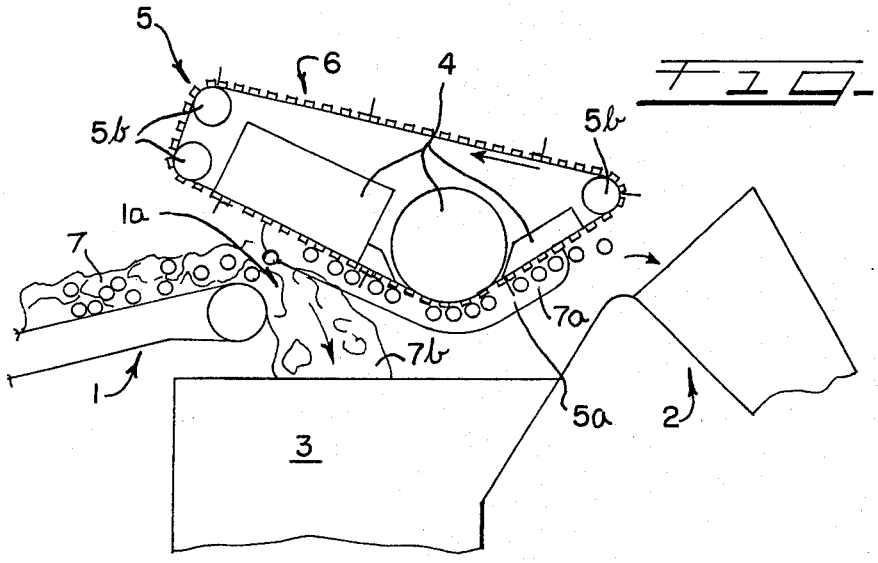
FIG. 1 is a side perspective view of a magnetic separator system having the conveyor belt of the present invention associated therewith.
Figure 2:
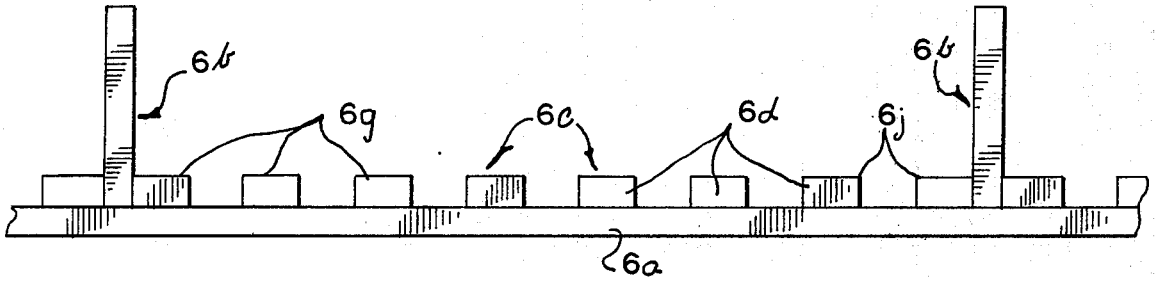
FIG. 2 is a side elevational view of a portion of the conveyor belt.
Figure 3:
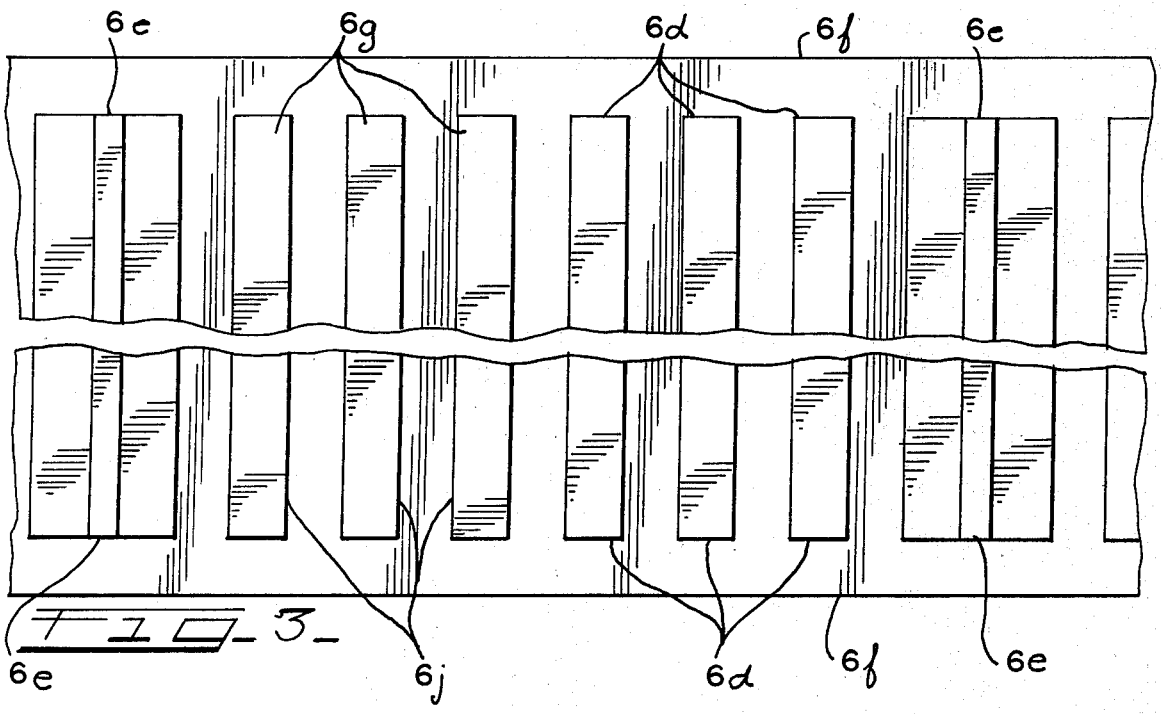
FIG. 3 is a top elevational view of the portion of conveyor belt of FIG. 2.

In the drawing there is illustrated a preferred mode of the invention comprising a magnetic waste separation system including a supply conveyor 1 and a magnetic materials collection chute 2, with a non-magnetic materials collection area 3 therebetween. A magnetic assembly 4 comprising one or more permanent or electro-magnets is located above the collection area 3, and a separator conveyor 5, including sidewalls **5*a*, rollers 5*b* and belt 6, is positioned in association therewith, such that the belt 6 is interposed between the magnetic assembly 4 and the supply conveyor 1 and passes over the non-magnetic materials collection area 3 and the magnetic materials collection chute 2**.

In operation, the supply conveyor 1 carries shredded waste material 7, composed of magnetic and non-magnetic materials **7*a* and 7*b* respectively, toward the magnetic assembly 4. As the waste 7 approaches the end 1*a* of the supply conveyor 1, the magnetic materials 7*a* are drawn toward the assembly 4 by the magnetic field generated thereby and are thus held against the belt 6**.

The conveyor belt 6 comprises a flat conveying member **6*a* composed of a suitable flexible material, preferably an elastomer such as fiber impregnated rubber, and has a plurality of regularly spaced, substantially rigid sweep bars 6*b* mounted transversely thereon. The belt 6 moves in a direction urging the magnetic material 7*a* being held thereagainst toward the collection chute 2. Upon reaching the end 4*a* of the magnetic assembly 4, the magnetic materials 7*a* leave the magnetic field and drop onto the collection chute 2. The non-magnetic materials 7*b*, upon reaching the end 1*a* of the supply conveyor 1, discharge into the non-magnetic materials collection area 3**.

The natural laws governing magnetic attraction are such that the magnetic materials **7*a* are drawn to the center of the magnetic field and resist movement therefrom. As a result, the materials 7*a*, which have sharp, jagged edges produced during the shredding process, tend to concentrate along the centerline of the conveyor belt 6 where they are held in sliding contact therewith. Although the amount of slippage between the materials 7*a* and the moving belt 6 is limited by the sweep bars 6*b*, there is considerable scoring and abrading of the conveying member 6*a* in the areas between the sweep bars 6*b*, with the wear being most severe along the belt centerline. Further wear results from the "punching effect" as the material 7*a* strikes the member 6*a* after being drawn from the supply conveyor 1, thereby producing punctures and gouges. The net result of both of these effects is to severely limit the useful life of the belt 6**. In practice belt life averaged 6 weeks.

It has been discovered that by disposing protective cleats **6*c* on the conveying member 6*a* in a manner and arrangement hereinafter described, belt life was increased to 6 months. The cleats 6*c* are disposed transverse to the belt 6 and are regularly spaced between the sweep bars 6*b*. There are cleats 6*c* flanking each sweep bar 6*b*** and positioned in abuting relation, but not connected thereto.

Experiments indicate that the optimum dimensions of the cleats **6*c*, the spacing therebetween, and the height of the sweep bars 6*b* are related to the mode of the diametric dimensions of the magnetic materials 7*a* being separated. Preferably, cleat width is substantially equal to the space between two consecutive cleats 6***c*, where at least one of which cleats 6*c* does not abut a sweep bar 6*b*. This dimension is preferably between one-fourth and one-half of the modal diameter, with one-third the modal diameter being optimum. Likewise, it was found that the preferred height of the cleats 6*c* is substantially one-half their width and that the minimum height for the sweep bars 6*b* to prevent material from "climbing over" is three-fourths the modal diameter.

Thus, when separating waste wherein the magnetic materials 7*a* have a modal diameter of three inches, the belt 6 would preferably have cleats 6*c* one inch wide and one-half inch high, spaced one inch apart. The sweep bars 6*b* should be a minimum of 2¼ inches high. Both the cleats 6*c* and the sweep bars 6*b* should end at least one inch inwardly of the lateral edges 6*f*, 6*f* of the conveying member 6*a*.

Problems caused by materials jamming between the sidewalls 5*a* and the ends of the sweep bars 6*b* and cleats 6*c* are eliminated by having the ends 6*d*, 6*d* of the cleats 6*c* and ends 6*e*, 6*e* of the sweep bars 6*b* terminate inwardly of the lateral edges 6*f*, 6*f* of the conveying member 6*a*, leaving unobstructed borders on the member 6*a* of at least one-third of the modal diameter.

The cleats 6*c* are preferably formed of elastomeric material and are of rectangular cross-section to provide flexible edges which are deflectable by the material accelerating toward the belt 6. This feature, together with the mechanical raking of the edge 6*j* through the material 7*a* maximizes the tumbling or rolling of the attracted magnetic materials 7*a* as the moving belt 6 drags on the resisting materials 7*a*. This tumbling causes entrained non-magnetic material 7*b* to be released or shaken free whereupon it falls into the non-magnetic materials collection area 3. It will be noted that both the sweep bars 6*b* and the cleats 6*c* are formed as single linear sections to accommodate passage of the belt 6 over the rollers 5*b*. Preferably the top side 6*g* of each cleat 6*c* is flat and the leading and trailing sides 6*h* and 6*i* are normal to the belt base web 6*g*.

I claim:

1. An improved belt member for use in a magnetic separating device of the type wherein a moving conveyor is interposed between a magnetic assembly and a waste aggregate comprising a mixture of magnetic and nonmagnetic materials, and wherein the magnets attract said magnetic materials, draw it from said mixture, and hold it in sliding contact with said moving belt member, said sliding contact resulting in severe scoring and abrading of said belt member; the improvement comprising a plurality of protective tumble-inducing cleats on the outer surface of said belt member, said belt member including a plurality of regularly spaced, outwardly projecting transverse sweep bars and said cleats being regularly spaced with respect to said sweep bars, said cleats being substantially rectangular in cross-section and lying transverse said belt member, and a cleat abutting each of said sweep bars on the downstream side thereof.

2. The invention of claim 1, wherein a cleat abuts each of said sweep bars on the downstream side thereof.

3. The invention of claim 1, wherein the height of said sweep bars is at least three-quarters the modal diameter of said magnetic materials.

4. The invention of claim 2, wherein the width of said cleats is between one-quarter and one-half said modal diameter.

5. The invention of claim 4, wherein said width is approximately one-third said modal diameter.

6. The invention of claim 1, wherein the space between two consecutive cleats, at least one of which does not abut one of said sweep bars, is substantially equal to the width of one of said cleats.

7. The invention of claim 1, wherein said cleats and said sweep bars terminate inwardly of the periphery of said belt member.

8. The invention of claim 7, wherein the distance between said periphery and said ends of said cleats and said sweep bars is at least one-third said modal diameter.

9. The invention of claim 8, wherein said cleats and sweep bars each comprise a single linear section.

10. The invention of claim 9, wherein the height of said cleats is substantially one-half the width thereof.

* * * * *